US005969476A

United States Patent [19]

Labant

[11] Patent Number: 5,969,476

[45] Date of Patent: Oct. 19, 1999

[54] ENVIROMENTALLY SAFE YELLOW BUG LIGHT

[75] Inventor: Cynthia J. Labant, St. Marys, Pa.

[73] Assignee: Osram Sylvania, Inc., Danvers, Mass.

[21] Appl. No.: 09/046,866

[22] Filed: Mar. 24, 1998

Related U.S. Application Data

[60] Provisional application No. 60/048,449, Jun. 3, 1997.

[51] Int. Cl.[6] ..... H01K 1/32

[52] U.S. Cl. ..... 313/635; 313/112; 313/116

[58] Field of Search ..... 313/635, 112, 313/116

[56] References Cited

U.S. PATENT DOCUMENTS

| | | | |
|---|---|---|---|
| 2,995,463 | 10/1961 | Meister et al. | 117/17 |
| 3,125,457 | 3/1964 | Meister | 117/17 |
| 3,320,460 | 5/1967 | Bouchard et al. | 313/112 |
| 4,633,127 | 12/1986 | Beurskens et al. | 313/112 |
| 5,177,395 | 1/1993 | Reisman | 313/112 |
| 5,252,887 | 10/1993 | Reisman | 313/112 |

*Primary Examiner*—Ashok Patel
*Attorney, Agent, or Firm*—William H. McNeill

[57] ABSTRACT

A yellow bug lamp whose coating is cadmium-free. The coating comprises sulfate precipitated silica, aluminum silicate pigment, zirconium praseodymiun yellow zircon and nickel titanium yellow rutile and has color coordinates of x=0.5341 to 0.5406 and y=0.4400 to 0.4378.

4 Claims, 2 Drawing Sheets

ENVIROMENTALLY SAFE YELLOW BUG LIGHT

I hereby claim the benefit under Title 35, United States Code, § 119 (e), of United States Provisional Application No. 60/048449, filed Jun. 3,1997.

TECHNICAL FIELD

This invention relates to lamps and more particularly to bug lamps. Still more particularly, it relates to bug lamps which do not contain cadmium or antimony. Even more particularly, the present invention relates to a yellow bug lamp which comprises a vitreous envelope enclosing a light source. The envelope has a coating on a surface thereof which is free of cadmium and antimony.

BACKGROUND ART

Bug lamps which emit yellow light are known. Such lamps generally derived their yellow color by virtue of a coating on a surface thereof, which coating contained large amounts of cadmium. Recently, the disposal of such lamps has raised environmental concerns because of the danger of the cadmium entering into ground water supplies or otherwise causing potential damage to the environment. One solution to the problem has been disclosed in U.S. Pat. No. 5,177,395, wherein the main color component comprises rutile titanium dioxide containing antimony and chromium. However, this coating can also contain up to 15% cadmium. Additionally, some of the prior art coatings, which have a high bulk density, are difficult to coat causing agglomerates, pinholes and/or stratifications.

DISCLOSURE OF INVENTION

A major object of the invention is the obviation of the problems of the prior art.

Another object of the invention is to enhance bug lamps.

It is another object of the invention to eliminate potentially hazardous materials from bug lamps.

Yet another object of the invention is the provision of a lamp which emits in the yellowish orange region of the ICI color diagram.

A still further object of the invention is the provision of a sutiable yellow coating for lamps that is free from the processing problems of the prior art.

These objects are accomplished, in one aspect of the invention, by an electric lamp which emits a yellow color when energized and which comprises a light transmissive envelope enclosing an electric light source within. The envelope has a surface on which is a coating comprising sulfate precipitated silica, aluminum silicate pigment, zirconium praseodymiun yellow zircon and nickel titanium yellow rutile. This coating is substantially free of cadmium. Further, the coating material has a lesser bulk density than previous coatings and coats well in standard coating operations.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
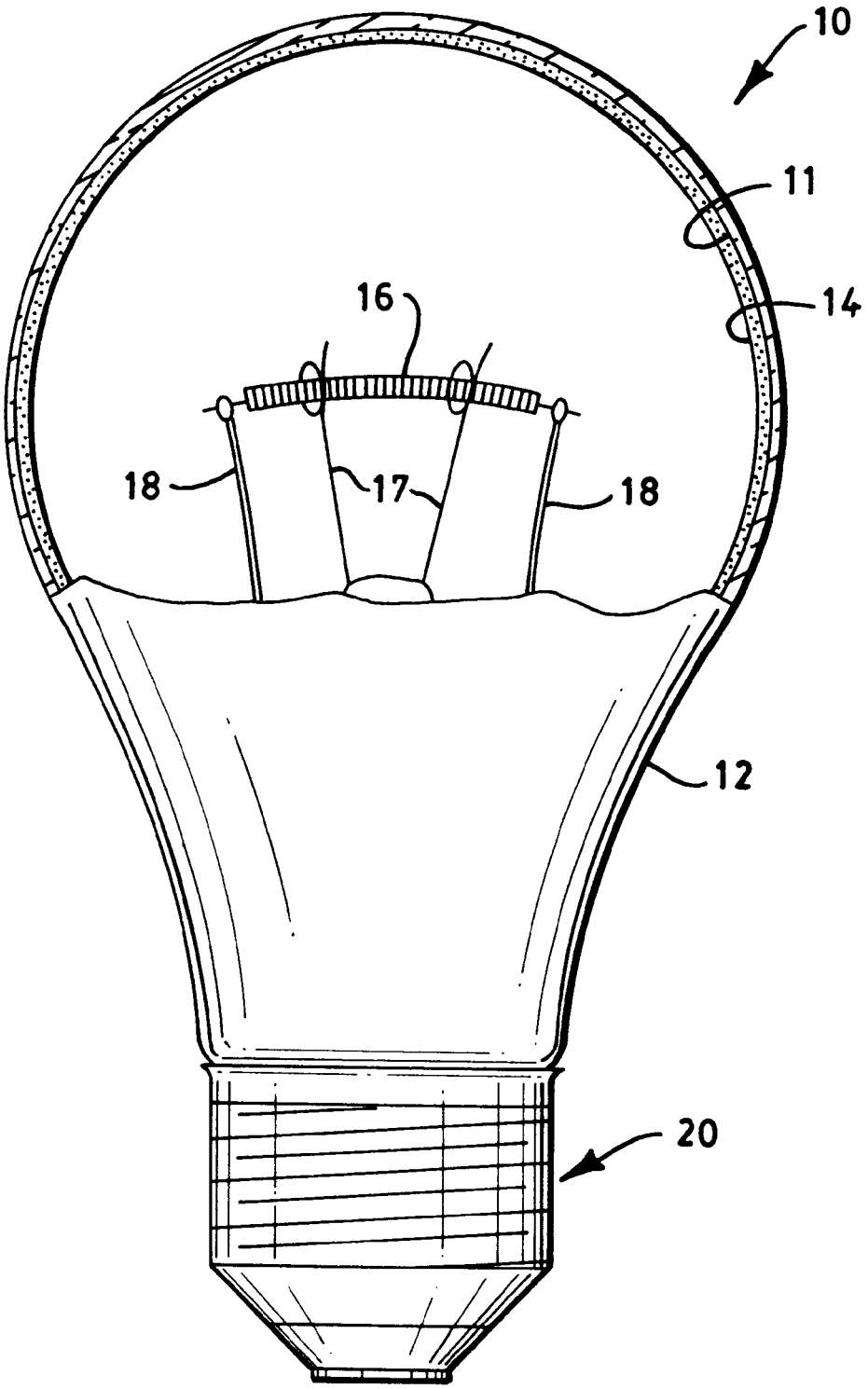
FIG. 1 is an elevational view of a lamp according to an aspect of the invention, partially in section.

Referring now to the drawings with greater particularity, there is shown in FIG. 1 an A-line incandescent type lamp 10 having on an interior surface 11 of its light transmissive glass envelope 12 a coating 14 in accordance with an aspect of the invention. A filament 16 of, for example, tungsten, is electrically connected to and supported by lead-ins 18 which extend through the seal of the lamp and are attached, as is known, to a screw base 20. Other forms of bases can be employed, such as the type known in the art as bayonet bases. Additionally, other support for the filament 16 can be provided by support wires 17.

The interior surface 11 of envelope 12 is coated with a powder coating 14. Coating 14 is applied electrostatically by means well know to those skilled in the art, see, for example U.S. Pat. Nos. 2,995,463; 3,125,457; 3,320,460 and 4,633,127.

Figure 2:
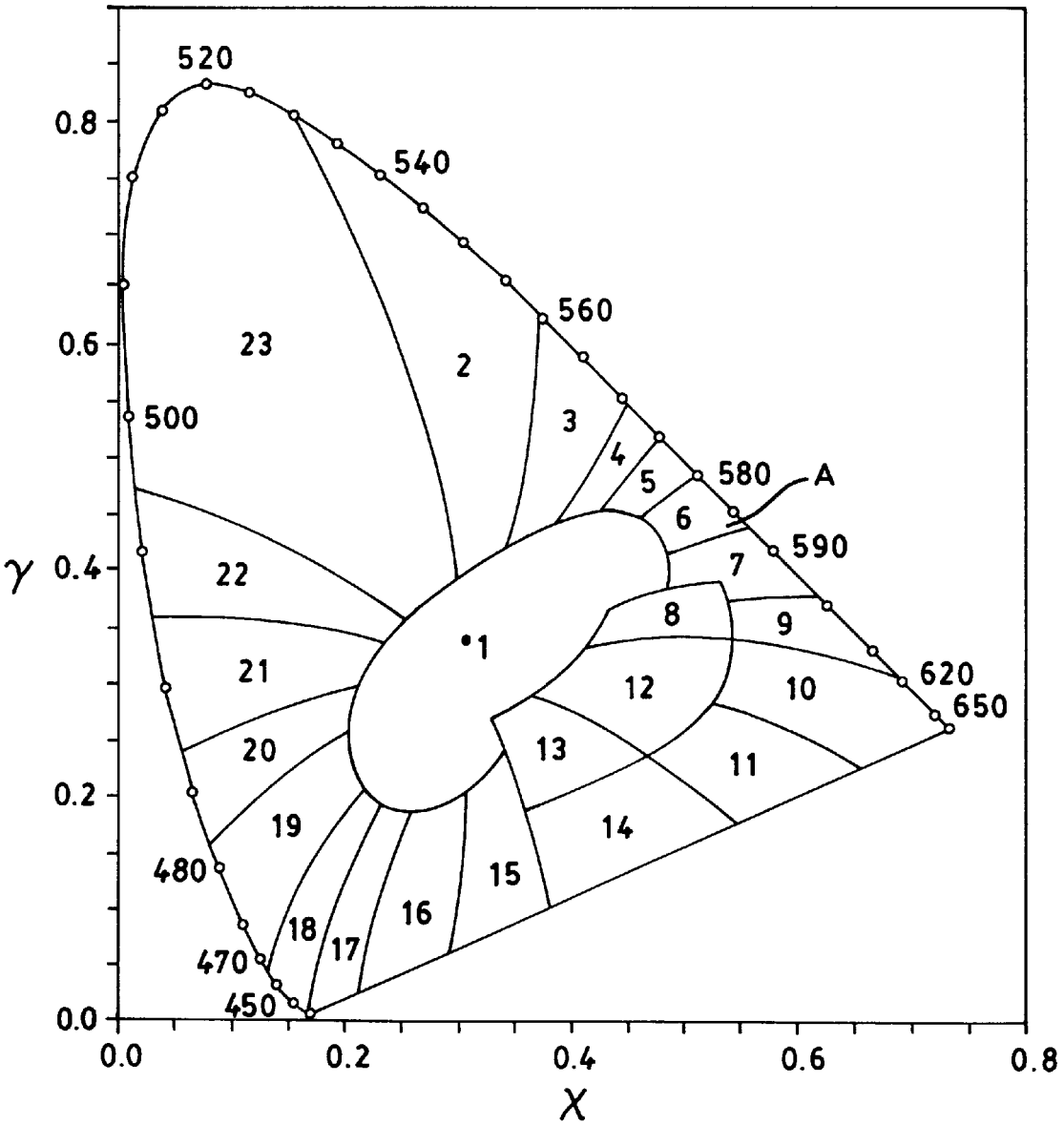
FIG. 2 is a representation of the standard ICI color diagram illustrating the coordinates of lamps made according to the invention.

The coating 14 of the present invention comprises sulfate precipitated silica, aluminum silicate pigment, zirconium praseodymium yellow zircon and nickel titanium yellow rutile. The coating is free from cadmium and provides, particularly when illuminated, a yellow characterized as yellowish orange and having coordinates of x=0.5341 to about 0.5406 and y=0.4378 to about 0.4400 on a standard ICI diagram. The ICI diagram and the location of the material herein described (designated A) is illustrated in FIG. 2. The ICI diagram (International Commission on Illumination) is also known, especially in England and the European continent as the CIE (Commission Internationale d'Eclairage) system or diagram.

The applied powder was formulated by combining, in weight percent, 25% PPG Lovel 27 Synthetic Sulfate Precipitated Silica; 25% Burgess 50 Aluminum Silicate Pigment; 20% Englehard 6310 Zirconium Praseodymium Yellow Zircon; and 30% Shepard Yellow #182 Nickel Titaium Yellow Rutile. The nickel titanium yellow rutile comprises, in weight percent, about 46.90% oxygen, about 11.18% antimony, about 38.11% titanium, about 0.34% vanadium and about 3.46% nickel, and the zirconium praseodymiun yellow zircon comprises, in weight percent, about 29.35% oxygen, about 17.25% silicon, about 49.00 zirconium and about 4.41% praseodymium.

Lamps coated with this material were compared to standard 60 watt Soft White lamps and conventional bug lights having a high cadmium content in the coatings. All lamps were in conventional A19 envelopes. The results are shown in Table I.

TABLE I

All lamps read at 120.0 volts Base Up

| Lamp Number | Lamp Current | Lamp Watts | Lumens (Spectral) | LPW | Color Temp | Chromaticity x | Chromaticity y |
|---|---|---|---|---|---|---|---|
| SYLVANIA 60W/120VA19 Soft White | | | | | | | |
| 1 | 0.5066 | 60.8 | 872 | 14.3 | 2768 | 0.4549 | 0.4102 |
| 2 | 0.5042 | 60.5 | 869 | 14.4 | 2767 | 0.4549 | 0.4102 |
| Average | 0.5054 | 60.6 | 871 | 14.4 | 2768 | 0.4549 | 0.4102 |

TABLE I-continued

| Lamp Number | Lamp Current | Lamp Watts | Lumens (Spectral) | LPW | Color Temp | Chromaticity x | Chromaticity y |
|---|---|---|---|---|---|---|---|
| All lamps read at 120.0 volts Base Up | | | | | | | |
| SYLVANIA 60W/120V A19 Bug Yellow C483 Powder (Current Production) | | | | | | | |
| 1 | 0.5040 | 60.5 | 622 | 10.3 | 2144 | 0.5329 | 0.4453 |
| 2 | 0.5072 | 60.9 | 761 | 12.5 | 2403 | 0.5051 | 0.4449 |
| Average | 0.5056 | 60.7 | 692 | 11.4 | 2274 | 0.5190 | 0.4451 |
| SYLVANIA 60W/120V A19 Bug Yellow BLEND #23 (Test Material) | | | | | | | |
| 1 | 0.5056 | 60.7 | 589 | 9.7 | 2101 | 0.5341 | 0.4400 |
| 2 | 0.5046 | 60.6 | 544 | 9.0 | 2036 | 0.5406 | 0.4378 |
| Average | 0.5051 | 60.6 | 567 | 9.3 | 2069 | 0.5374 | 0.4389 |

Thus, there is here provided a yellow bug lamp having color chromaticity within the yellowish orange area of the ICI diagram and, being free of cadmium, is safely disposable in normal landfills.

While there have been shown and described what are at present considered the preferred embodiments of the invention, it will be apparent to those skilled in the art that various changes and modifications can be made herein without departing from the scope of the invention as defined by the appended claims.

What is claimed is:

1. An electric lamp which emits a yellow color when energized and which comprises a light transmissive envelope enclosing an electric light source within, said envelope having a surface on which is a coating comprising sulfate precipitated silica, aluminum silicate pigment, zirconium praseodymiun yellow zircon and nickel titanium yellow rutile, said coating being substantially free of cadmium.

2. The lamp of claim 1 wherein said nickel titanium yellow rutile comprises, in weight percent, about 46.90% oxygen, about 11.18% antimony, about 38.11% titanium, about 0.34% vanadium and about 3.46% nickel.

3. The lamp of claim 1 wherein said zirconium praseodymiun yellow zircon comprises, in weight percent, about 29.35% oxygen, about 17.25% silicon, about 49.00 zirconium and about 4.41% praseodymium.

4. The lamp of claim 1 wherein said yellow color emitted when said lamp is energized has coordinates of x=about 0.5341 to about 0.5406 and y=0.4378 to about 0.4400 on a standard ICI diagram.

* * * * *